United States Patent [19]

Rassieur

[11] Patent Number: 5,062,490

[45] Date of Patent: Nov. 5, 1991

[54] KELLY BAR COUPLING

[75] Inventor: Charles L. Rassieur, St. Louis County, Mo.

[73] Assignee: Central Mine Equipment, St. Louis, Mo.

[21] Appl. No.: 455,948

[22] Filed: Dec. 22, 1989

[51] Int. Cl.[5] ..... E21B 3/04

[52] U.S. Cl. ..... 173/104; 173/166; 175/195

[58] Field of Search ..... 173/26, 28, 104, 40, 173/41, 163, 165, 166; 175/195

[56] References Cited

U.S. PATENT DOCUMENTS

| | | | |
|---|---|---|---|
| 2,628,646 | 2/1953 | Bailey et al. | 173/165 |
| 3,014,543 | 12/1961 | Pond | 173/166 |
| 3,309,898 | 3/1967 | Fehrmann et al. . | |
| 3,452,829 | 7/1969 | Smith | 173/28 |
| 3,525,404 | 8/1970 | Newman et al. | 173/28 |
| 3,561,545 | 2/1971 | Rassieur | 173/166 |
| 4,638,871 | 1/1987 | Rassieur | 173/26 |

FOREIGN PATENT DOCUMENTS

| | | | |
|---|---|---|---|
| 609861 | 6/1978 | U.S.S.R. | 173/165 |

*Primary Examiner*—Douglas D. Watts
*Assistant Examiner*—Scott A. Smith
*Attorney, Agent, or Firm*—Polster, Polster and Lucchesi

[57] ABSTRACT

In an earth drill rig having a drive with a drive stud projecting from it, a Kelly bar, connected to drive a rotary table, and a coupling device associated with the Kelly bar and drive stud for selectively connecting the drive stud to a lower end of the Kelly bar, and a mast carrying the Kelly bar and adapted to be rotated about a pivot axis offset from the long axis of the Kelly bar from an erected position to a folded position, during which the Kelly bar is arcuately translated away from the drive stud, and to be rotated from the folded position to the erected position, during which the lower end of the Kelly bar is arcuately translated toward the drive stud, the Kelly bar is moved axially in a direction away from the drive stud and moved axially in a direction toward the drive stud to permit the coupling and uncoupling of the Kelly bar and the drive stud.

6 Claims, 3 Drawing Sheets

KELLY BAR COUPLING

BACKGROUND OF THE INVENTION

A common, commercially available coupling arrangement between a Kelly bar and a stud or stub shaft of an earth drill drive is illustrated and described in Fehrmann and Rassieur U.S. Pat. No. 3,309,898. A flexible coupling is slidably mounted on the Kelly bar, and is gravity biased toward its free end. It is held out of the way of a drive shaft or stud by means of a pin inserted in a hole in the Kelly bar, and when the Kelly bar and stud are aligned, the pin is pulled and the flexible coupling permitted to engage the stud. In order to disconnect the stud and Kelly bar, the flexible connector is raised manually, and the pin replaced. Especially with large drill rigs, the flexible connector, which is generally made up of heavy steel hubs connected with a heavy chain, is massive and difficult to handle manually. Furthermore, with any size drill rig, there is always the danger that the pin will fall out or not be put in properly, and the coupling will slide off the Kelly bar and into the hole being drilled.

One of the objects of this invention is to provide a Kelly bar coupling arrangement that requires no manual handling of the coupler.

Another object of this invention is to provide such a coupler that can not inadvertently be dropped from the rig.

Yet another object is to provide a coupling system in which uncoupling of the Kelly bar and drive stud is ensured before the mast that carries the Kelly bar can be folded.

Other objects of this invention will be apparent to those skilled in the art in light of the following description and accompanying drawings.

SUMMARY OF THE INVENTION

In an earth drill rig having a drive with a drive stud projecting from it, a Kelly bar, connected to drive a rotary table, and coupling means associated with the Kelly bar for selectively connecting the drive stud to a lower end of the Kelly bar, and a mast carrying the Kelly bar and adapted to be rotated about a pivot axis offset from the long axis of the Kelly bar from an erected position to a folded position, means are provided for moving the Kelly bar axially in a direction away from the drive stud and for moving the Kelly bar axially in a direction toward the drive stud to permit the coupling means to engage the drive stud and Kelly bar to transmit rotary motion from the drive stud to the Kelly bar when the mast is erected, and to disengage the drive stud and Kelly bar before the mast is rotated to its folded position.

Preferably, the coupling is a flexible coupling of the general type illustrated in Fehrmann and Rassieur, U.S. Pat. No. 3,309,898, slidably mounted on the Kelly bar but prevented from sliding off the end of the Kelly bar. Preferably, also, the means for moving the Kelly bar axially comprise a hydraulic cylinder and a piston connected to the upper end of the Kelly bar, and an interlock system for preventing folding of the mast until the Kelly bar is moved axially away from the drive stud sufficiently to ensure that the coupling means are clear of the drive stud.

DESCRIPTION OF THE PREFERRED EMBODIMENT

Figure 1:
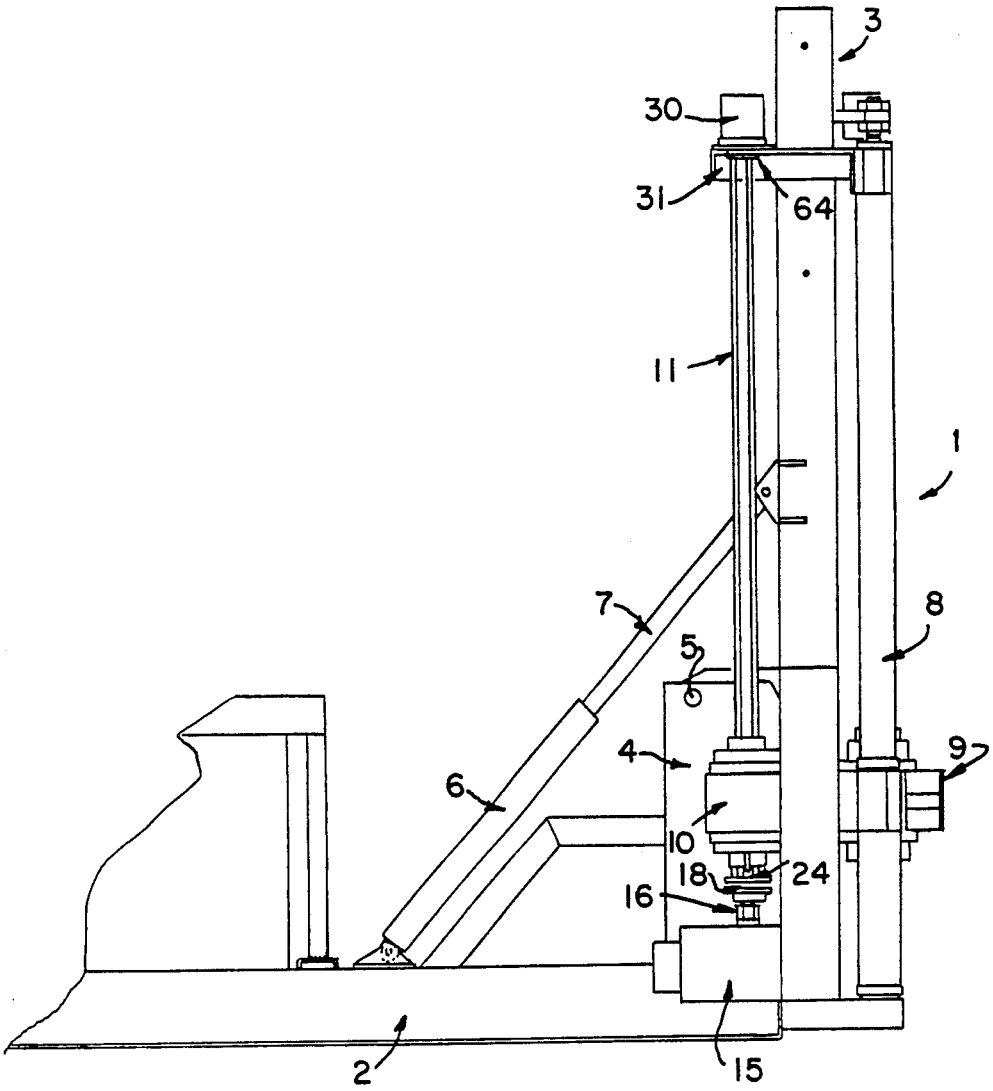
FIG. 1 is a view in side elevation, party diagrammatic, illustrating a drilling rig of which the coupling mechanism of the invention is a part.
Figure 2:
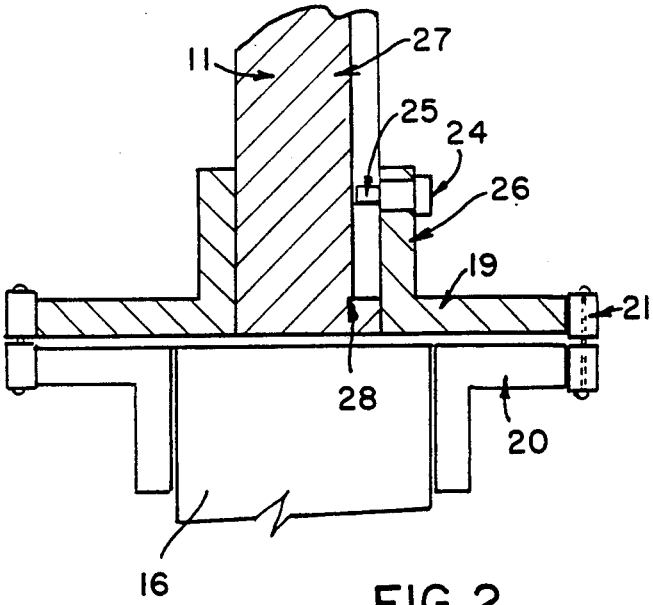
FIG. 2 is a sectional view of a lower end of the Kelly bar of FIG. 1 on which a flexible coupling is mounted.
Figure 5:
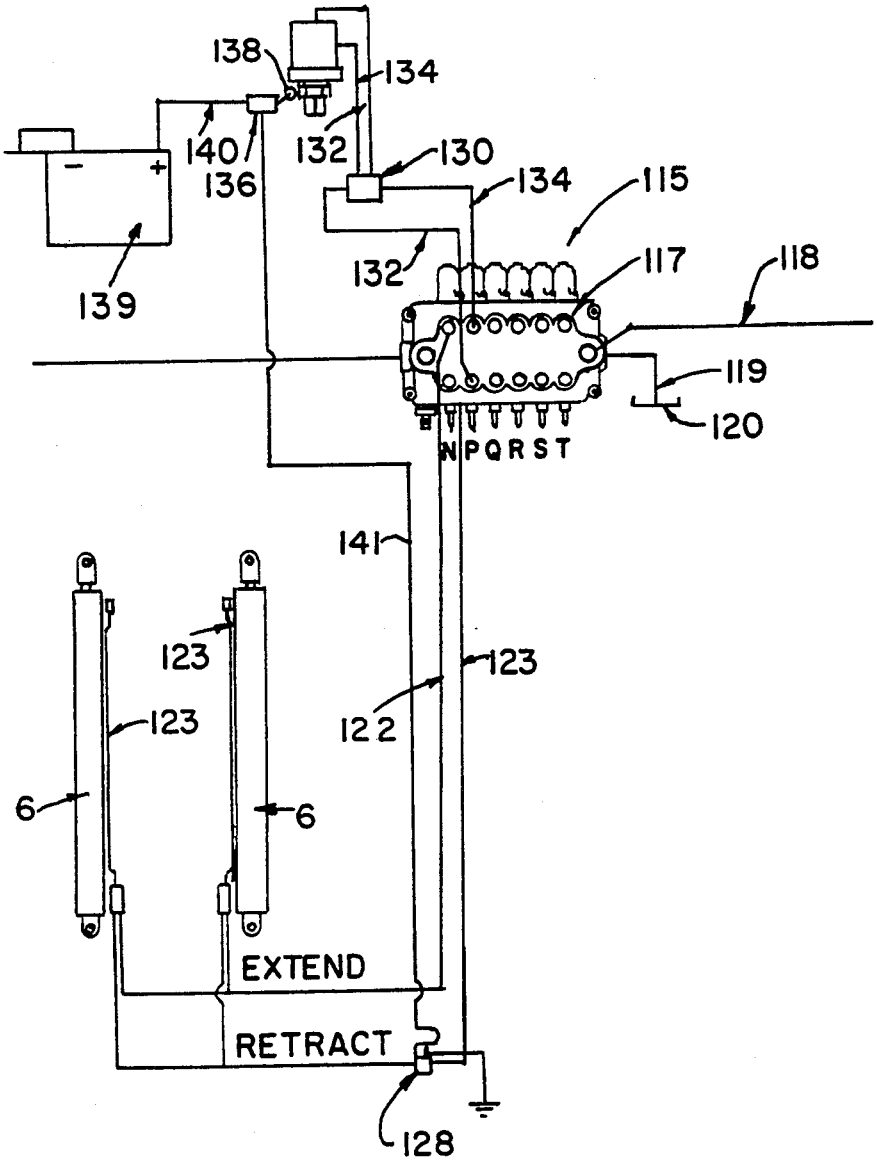
FIG. 5 is a diagrammatic view of the hydraulic and electrical system controlling the erection of the mast and the axial movement of the Kelly bar.

Referring now to the FIG. 1, reference numeral 1 indicates a typical drill rig, with a platform 2 mounted on a vehicle, and a mast 3 of the general type illustrated in FIGS. 5 and 6 of U.S. Pat. No. 4,638,871. The mast 3 is pivotally mounted on hinge plates 4 secured to the platform. The entire mast and drive assembly mounted on the mast pivot around a pivot 5 carried by the hinge plates 4. The mast is rotated about the pivot 5 by means of hydraulic cylinders 6 and piston rods 7. A drill drive assembly 8 of the general type shown in U.S. Pat. No. 3,561,545 is carried by the mast on the after side of the mast in relation to a vehicle, and includes a rotary table 9. The rotary table 9 has a common housing with a chain drive 10, which is driven by a Kelly bar 11 on which the chain drive is slidably mounted for movement axially of the Kelly bar. A right angle drive 15 has a vertically disposed drive stud 16 which, in this embodiment, is shown as being hexagonal. The Kelly bar, also, is shown as being hexagonal in cross-section through the length on which the chain drive rides. These elements are all conventional.

A coupling 18 is of the general type shown in U.S. Pat. No. 3,309,898 and in FIGS. 5 and 6 of U.S. Pat. No. 4,638,871. The coupling 18 has an upper hub 19, a lower hub 20, and a surrounding chain 21. In this embodiment, a bolt 24, with a projecting nose 25 at its inner end, is threaded through a side wall 26 of the upper hub 19. The projection 25 extends into an axial groove 27 which ends at its axially lower end in a ledge 28.

At the axially upper end of the Kelly bar 11, a Kelly bar raising and lowering mechanism 30 is mounted on an arm 31 carried by the mast 3. In this embodiment, the Kelly bar raising assembly includes a hollow, cylindrical piston 32, with a cylindrical side wall 33 with an upper, outwardly stepped area or annular boss 34. Ring grooves 35 are formed in the circumference of the boss 34, to mount sealing rings 36. The wall 32 also has a lower, inwardly stepped externally threaded area 37. Within the piston 32, the cylindrical side wall defines a lower chamber 40 and an upper chamber 41, separated by and in part defined by an intermediate wall 42. The side wall defining the lower chamber 40 has a radially inward step 44 near its upper end and a radially outward lower step 45 toward its lower end. The step 44 serves as a shoulder for an outer race of a tapered roller bearing 47, an inner race 49 of which projects axially at both ends beyond the outer race 48.

The upper end of the Kelly bar 11 is turned down to produce a reduced cylindrical end section 51 and an intermediate cylindrical section 52, defining between them an annular shoulder 53, which engages a radial surface of the lower end of the inner race 49 of the tapered roller bearing 47. The upper end of the Kelly bar is drilled and tapped to form an internally threaded socket 55, through the bottom of which is an axial grease passage 56, that communicates at its inner end with a radial grease passage in which a grease fitting 58 is threaded. The radial passage is counter bored as indicated at 57, to permit the grease fitting to be recessed below the surface of the Kelly bar.

A bolt 59 with a head 60 is threaded into the socket 55. The underside of the head 60 has a radially flat surface that engages the upper end of the inner race 49, so that the inner race 49 is caged axially between the bolt head 60 and the shoulder 53 of the Kelly bar. The bolt 59 has a axial passage 61 extending entirely through it, which communicates with the grease passage 56, so that grease introduced at the fitting 58 can pass through the passages 56 and 61, over the bolt head and through the bearing 47, and past a seal 70 seated in a seat in a bearing and seal retainer 69. A nose closure 64 has a cylindrical side wall 65 internally threaded, complimentarily to the external threads on the lower end of the piston wall 33. At the lower end of the side wall 65, the closure 64 has a radially inwardly extending flange 67 and a radially outwardly extending flange 68. The inwardly extending flange 67 holds the bearing retainer 69. The upper edge of the bearing retainer 69 bears against a radial lower surface of the outer race 48 of the roller bearing 47. The outwardly extending flange 68 serves as a trip mechanism for an interlock switch 136 to be described hereafter.

The upper chamber of the piston has an inner side wall, in which keyways 76 are cut. The uppermost surface of the piston is relieved radially inwardly, to form a pilot chamber 79. As can be readily appreciated from the drawing, the piston 32 is mounted to move axially in a cylinder 85. The cylinder 85 has a side wall 86 which is externally threaded at its lower end. A cylinder internal wall 88 is stepped toward its lower end to form shoulders 89 and 90. A cylinder liner 72 has a radially outwardly extending flange that engages the shoulder 89, and a radially flat upper edge that engages the shoulder 90. The liner 72 has, on an inside cylindrical surface, ring grooves 73, in which seals 74 are seated to seal against the outer cylindrical surface of the piston. An outer cylindrical surface of the liner 72 is also provided with an annular groove, in which an O-ring 81 is seated to bear against the inside cylindrical surface of the cylinder.

A hydraulic fluid passage 91 extends radially through the cylindrical side wall of the cylinder 85, and communicates with a chamber 98 defined between the side wall 33 of the piston and the inside surface of the cylinder, and between an upper end of the liner 72 and the lower radially extending edge of the area or boss 34.

The cylinder 85 is closed at its upper end by a closure 92. The closure 92 has a cover part in the form of a circular plate welded along an outer margin to the upper end of the cylinder, and a radially centered stud 93, projecting downwardly into the upper chamber of the piston. The stud 93 has keys on it that extend slidably into the keyways 76 of the piston, to prevent rotation of the piston with respect to the cylinder.

A central hydraulic fluid passage 95 extends axially through the radial center of the plate and stud, opening at both ends. At its upper end, it is provided with a suitable fitting to a hydraulic line, as is the hydraulic fluid passage 91. A radial hydraulic fluid passage extends from the passage 95 radially through one side of the stud 93 at a place at which it can communicate with the pilot chamber 79, and, as the piston moves down, with the area around the upper end of the piston.

The cylinder is mounted on a base 105, which is, in turn, mounted on the beam 31. The base includes a base ring 106 with an integral cylindrical collar 108 threaded internally complimentarily to the externally threaded lower end 37 of the cylinder, which is screwed down into the collar 108 against an upper surface of a part of the base ring radially inboard of the collar 108. The part of the base ring 106 that extends radially outboardly of the collar 108 has suitable bolt holes, not here shown, to permit its being mounted on the beam 31. The beam 31 has an opening in it, not here shown, through which the nose closure 64 and, when the piston is extended from the cylinder, a portion of the piston extend.

Referring now to FIG. 6, reference numeral 115 indicates a hydraulic and electric control system of this embodiment of the invention. The system 115 includes a hydraulic valve 117, to which a pressure line 118, from a source of pressure not here shown, is connected, and a return line 119 leading to a sump 120. An "extend" hydraulic line is connected at one end to the valve 117 and at its other to the lower ends of the cylinders 6. A "retract" hydraulic line 123 is connected at one end to the valve 117 and at its other end to the upper end of the cylinders 6. A solenoid shut-off valve 128 is connected in the line 123, and is normally biased closed, to cut off communication between the valve 117 and the upper end of the cylinders 6.

A Kelly bar "raise" hydraulic line 132 is connected at one end to the valve 117 and at its other end, to the port 91 in the cylinder 85, by way of a check valve 130. A Kelly bar "lower" line 134 is connected at one end to the valve 117 and at its other, by way of the check valve 130, to the hydraulic port 95 in the top of the cylinder 85.

Figure 3:
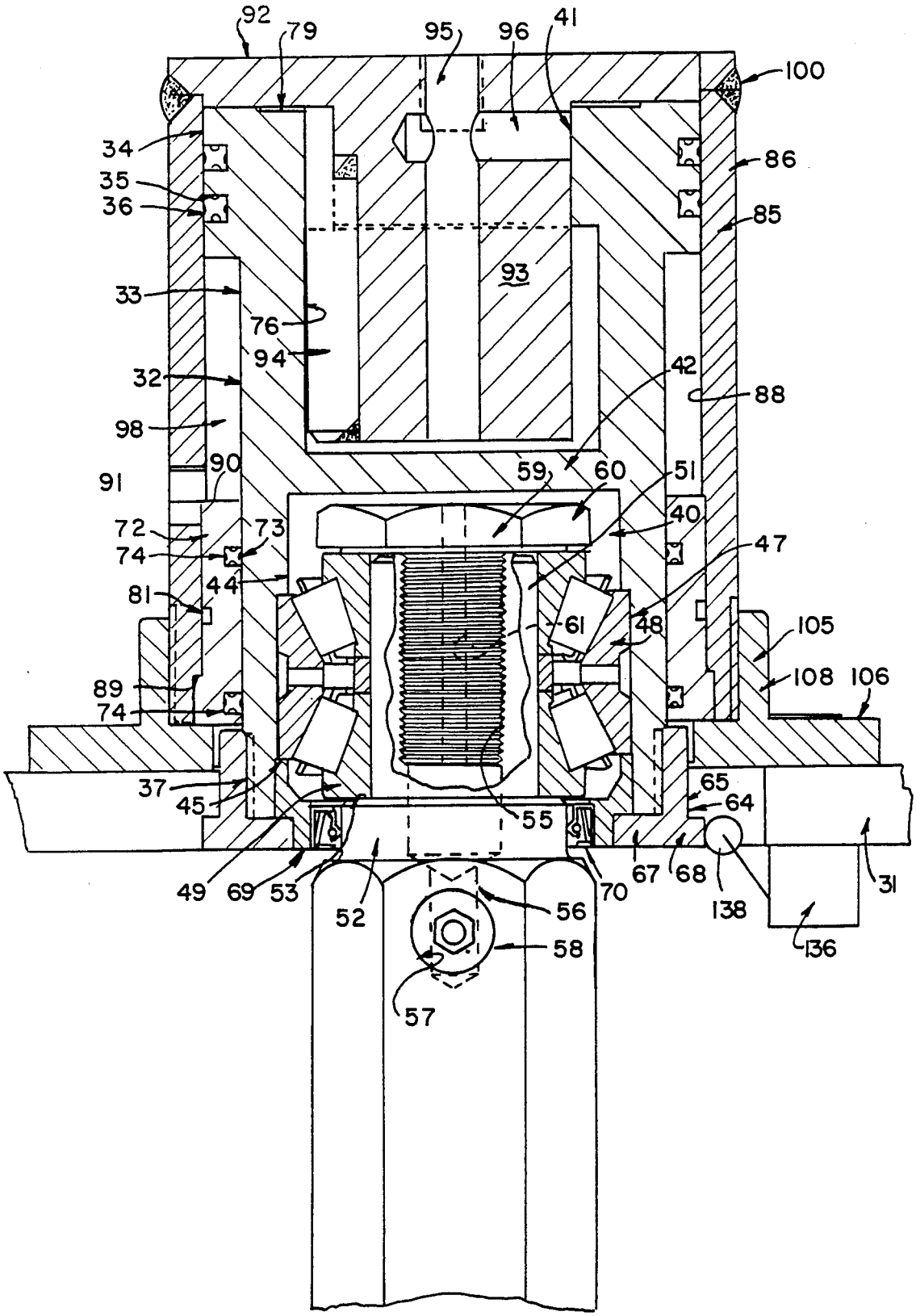
FIG. 3 is a sectional view of a Kelly bar lifting mechanism shown in FIG. 1.
Figure 4:
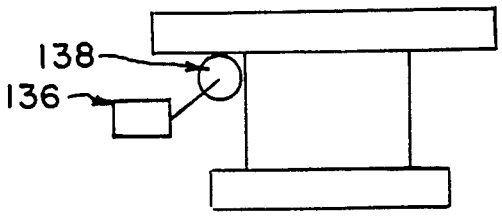
FIG. 4 is a detail fragmentary view in side elevation of an interlock switch and its relation to the Kelly bar lifting mechanism.

An interlock switch 136 is mounted on the underside of the beam adjacent the nose closure 64, with a switch actuator 138 biased toward the nose closure and piston, as shown particularly in FIGS. 3 and 4. The actuator 138 is so arranged as to open the circuit when it is in the position shown in FIG. 4, and to close the circuit when it is biased toward the switch box by the radially outwardly extending flange 68 of the nose closure 64. When the interlock switch 136 is closed, by virtue of the movement of the actuator to the position shown in FIG. 3, it completes a circuit to the solenoid valve 128, causing that valve to open. To that end, the switch is electrically connected to a source of power 139, in this illustrative embodiment, a battery by an electrical conductor 140, and to the solenoid switch 128 by an electrical conductor 141.

In operation, assuming that the mast is in its folded position, with the piston rod 7 fully retracted, the valve 117 is thrown to the position at which hydraulic fluid from the pressure line 118 is directed through the line 122, to extend the piston rods and raise the mast to the vertical. The Kelly bar 11 will have been raised to its uppermost position, as shown in FIGS. 1 and 3, by virtue of having had hydraulic fluid from the pressure line 118 directed by the valve 117 through the line 132 and the side port 91 to till the chamber 98 and force the piston to the top of the cylinder. When the valve is returned to a neutral position, the check valve 130 acts to lock the piston in place. At this position, the flexible coupling 18 is positioned directly over the drive stud 16. The Kelly bar is then lowered, by exhausting the chamber 98 through the port 91, the check valve being opened, and admitting hydraulic fluid under pressure through the line 134 to the passage 95, permitting hydraulic fluid to move through the axial passage 95 and to flow between the lower end of the stud 93 and the intermediate wall 42, and also through the radial passage 96, into the pilot chamber 79, forcing the piston down, thus lowering the Kelly bar and the coupling. The coupling will either rest upon the top of the drive stud, if the hexagonal opening in the lower hub 20 is not circumferentially aligned with the drive stud, or will drop down around the drive stud if it is aligned. If it is not aligned, the drive stud can be rotated very slowly until alignment is achieved, when the coupling will drop down around it. In either case, it will be seen that the provision of the slot in the Kelly bar permits the coupling to ride up axially until alignment is achieved. At the same time, the bolt nose 25 keeps the coupling from sliding off the end of the Kelly bar when the Kelly bar is raised.

The roller bearing 47 serves as a thrust bearing, and also serves to keep the Kelly bar aligned as it rotates.

When the mast is to be folded about the pivot 5, the valve 117 is first thrown to supply fluid under pressure to the line 132 and to exhaust hydraulic fluid through the line 134, the check valve 130 again being opened, causing the piston, hence the Kelly bar, to rise to its uppermost position, at which the lower hub 20 of the coupling 18 is clear of the drive stud. At that point, the interlock switch actuator 138 is moved outwardly of the piston by the flange 68, to close the interlock switch, and energize the solenoid valve 128, making it possible to supply hydraulic fluid under pressure to the line 123 and to exhaust the hydraulic fluid through the line 122, to cause the piston rods to retract, folding the mast. If it were not for the interlock switch, fluid could be supplied to the line 123 before the coupling were clear, leading to damage of the coupling or Kelly bar, or both. Similarly, the solenoid valve 128 prevents the exhaustion of the hydraulic fluid through the line 123, so as to prevent erection of the mast when the piston is in its downwardly extended position.

Numerous variations in the construction of the device of this invention, within the scope of the appended claims, will be apparent to those skilled in the art in light of the foregoing disclosure. Merely by way of example, the Kelly bar raising mechanism can be electrically operated rather than hydraulically operated. The particular structures of the piston and cylinder can be varied. The coupling means can also be different. Although it is not the preferred construction, the coupling can be fixedly mounted on the end of the Kelly bar, as long as provision is made to bring the Kelly bar down gently. The coupling can be mounted on the upper end of the drive stud, and the Kelly bar inserted in and retracted from the upper hub of the coupling. A different form of coupling, as in a solid socket, can be used. The drive stud and kelly bar can be made of different cross-sectional shape, as long as it is non-circular. The mast arrangement is one that is currently commercially available through Central Mine Equipment Company, but other arrangements of mast and drill drive mechanism can be used. These are merely illustrative.

Having thus described the invention, what is claimed and desired to be secured by Letters Patent is:

1. In an earth drill rig having a right angle drive with a drive stud projecting vertically upwardly from it, a table drive Kelly bar, connected to drive a rotary table mounted to move axially along said table drive Kelly bar, and coupling means associated with said table drive Kelly bar for selectively connecting said drive stud to a lower end of said table drive Kelly bar, and a mast carrying said table drive Kelly bar and adapted to be rotated about a pivot axis offset from the long axis of said table drive Kelly bar from an erected position to a folded position, whereby said lower end of said table drive Kelly bar is arcuately translated away from said drive stud, and to be rotated from said folded position to said erected position, whereby said lower end of said table drive Kelly bar is arcuately translated toward said drive stud, the improvement comprising means for mounting said coupling means on said table drive Kelly bar for axial sliding movement from a coupling position extending below the lower end of said table drive Kelly bar to a non-coupling position and means for limiting the downward sliding of said coupling means and holding said coupling means against sliding off the said table drive Kelly bar, means for moving said table drive Kelly bar axially in a direction toward said drive stud to permit said coupling means to receive and engage said drive stud and table drive Kelly bar, to transmit rotary motion from said drive stud to said table drive Kelly bar, and means for moving said table drive Kelly bar axially in a direction away from said drive stud to pull said coupling means away from said drive stud to decouple said table drive Kelly from said drive stud.

2. In an earth drill rig having a drive with a drive stud projecting from it, a Kelly bar, connected to drive a rotary table, and coupling means associated with said Kelly bar for selectively connecting said drive stud to a lower end of said Kelly bar, and a mast carrying said Kelly bar and adapted to be rotated about a pivot axis offset from the long axis of said Kelly bar from an erected position to a folded position, whereby said lower end of said Kelly bar is arcuately translated away from said drive stud, and to be rotated from said folded position to said erected position, whereby said lower end of said Kelly bar is arcuately translated toward said drive stud, the improvement comprising means for moving said Kelly bar axially in a direction away from said drive stud and for moving said Kelly bar axially in a direction toward said drive stud to permit said coupling means to engage said drive stud and Kelly bar to transmit rotary motion from said drive stud to said Kelly bar, and control means for actuating said means for moving said Kelly bar axially, said control means including interlock means for preventing folding of said mast until said Kelly bar is in upwardly retracted position to ensure that said coupling means are clear of said drive stud.

3. The improvement of claim 1 wherein said coupling means is slidably mounted on said Kelly bar, and means are provided for holding said coupling means in position to couple with said drive stud and for restraining said coupling means from sliding off the lower end of the Kelly bar.

4. In an earth drill rig having a drive with a drive stud projecting from it, a Kelly bar, connected to drive a rotary table, and coupling means slidably mounted on said Kelly bar for selectively connecting said drive stud to a lower end of said Kelly bar, and a mast carrying said Kelly bar and adapted to be rotated about a pivot axis offset from the long axis of said Kelly bar from an erected position to a folded position, whereby said lower end of said Kelly bar is arcuately translated away from said drive stud, and to be rotated from said folded position to said erected position, whereby said lower end of said Kelly bar is arcuately translated toward said drive stud, the improvement comprising means on said Kelly bar for holding said coupling means in position to couple with said drive stud and for restraining said coupling means from sliding off the said lower end of said Kelly bar, hydraulic cylinder and piston means for moving said Kelly bar axially in a direction away from said drive stud to raise said coupling means above said drive stud and to move said Kelly bar axially in a direction toward said drive stud to permit said coupling means to engage said drive stud to transmit rotary motion from said drive stud to said Kelly bar, check valve means for blocking flow of hydraulic fluid from said cylinder, and interlock means for preventing folding of the said mast until said Kelly bar is moved axially away from said drive stud sufficiently to ensure that said coupling means are clear of said drive stud.

5. In an earth drill rig having a right angle drive with a drive stud projecting vertically upwardly from it, a table drive Kelly bar, connected to drive a rotary table mounted to move axially along said Kelly bar, and coupling means associated with said Kelly bar for selectively connecting said drive stud to a lower end of said Kelly bar, and a mast carrying said Kelly bar and adapted to be rotated about a pivot axis offset from the long axis of said Kelly bar from an erected position to a folded position, whereby said lower end of said Kelly bar is arcuately translated away from said drive stud, and to be rotated from said folded position to said erected position, whereby said lower end of said Kelly bar is arcuately translated toward said drive stud, the improvement comprising means for moving said tale drive Kelly bar axially in a direction away from aid drive stud and for moving said Kelly bar axially in a direction toward said drive stud to permit said coupling means to engage said drive stud and Kelly bar, to transmit rotary motion from said drive stud to said Kelly bar, said means for moving said Kelly bar axially comprising a hydraulic cylinder with a closed upper end, an open-mouthed, cup-shaped piston connected to the upper end of said Kelly bar, and a fixed stud, extending from the closed end of said cylinder into said open cup-shaped piston, said piston having a radially outwardly extending annular seal boss, defining with an internal surface of said cylinder and a lower annular liner, a fluid receiving retracting cavity, and with the closed end of the cylinder another, extending, fluid receiving cavity, and means for introducing selectively hydraulic fluid into said retracting cavity to raise said piston and means for introducing hydraulic fluid into said extending cavity, for lowering said piston.

6. The improvement of claim 5 wherein said cylinder is connected by hydraulic lines to a valve connected to a source of hydraulic fluid under pressure, and a check valve is provided in said hydraulic lines to block flow of hydraulic fluid from said cylinder and to lock said piston in position.

* * * * *